United States Patent [19]

Walker

[11] 4,130,045

[45] Dec. 19, 1978

[54] STRING INSTRUMENT TUNING SYSTEM

[76] Inventor: William C. Walker, 7665 Marcin Dr., Glen Burnie, Md. 21061

[21] Appl. No.: 845,442

[22] Filed: Oct. 25, 1977

Related U.S. Application Data

[63] Continuation-in-part of Ser. No. 647,979, Jan. 9, 1976, Pat. No. 4,062,265.

[51] Int. Cl.[2] ..... G10D 3/14

[52] U.S. Cl. ..... 84/297 R; 84/312 R

[58] Field of Search ..... 84/297, 304–306, 84/312, 314

[56] References Cited

U.S. PATENT DOCUMENTS

| | | | |
|---|---|---|---|
| 936,624 | 10/1909 | Hale | 84/297 R |
| 2,070,916 | 2/1937 | Peate | 84/297 R |
| 2,514,835 | 7/1950 | Bredice | 84/297 R |
| 3,575,078 | 4/1971 | Currier | 84/173 |

*Primary Examiner*—Lawrence R. Franklin
*Attorney, Agent, or Firm*—Morton J. Rosenberg

[57] ABSTRACT

A musical instrument tuning system disposed and displayed upon a string instrument. The tuning system includes a first indicator displayed upon the surface of the string generally having three indicia zones representing a pitch alignment zone, a string tension load warning zone, and a zone indicating that the string is below pitch. The first indicator may take the form of a coating applied to the external surface of the string providing a plurality of visually discernable bands. A second indicator is displayed upon the instrument to provide a visual reference for the string markings. Rotatable displacement of a peg to which the string is fixedly secured provides for linear displacement of the bands with respect to the second indicator. Thus, rotation of the peg resulting in alignment of the tension load warning zone with the second indicator alerts the user that the string may rupture upon the addition of further tension. Opposite rotation of the peg resulting in alignment of the low pitch zone marking on the string with the second indicator demonstrates to the user that the string is tuned below pitch.

11 Claims, 3 Drawing Figures

STRING INSTRUMENT TUNING SYSTEM

REFERENCE TO RELATED PATENT APPLICATIONS

This Patent Application is a continuation-in-part application of U.S. patent application Ser. No. 647,979, filed Jan. 9, 1976, entitled String Instrument Tuning System, now issued as U.S. Pat. No. 4,062,265.

BACKGROUND OF THE INVENTION

Field of the Invention

This invention relates to musical instruments and more specifically to the tuning of such instruments. In particular, this invention pertains to the tuning of stringed instruments through visual indications. Additionally, this invention pertains to systems having alignable markings on the surface of strings which provide a visual reference of the proper tuning of a stringed instrument.

PRIOR ART

The tuning of stringed instruments is generally accomplished by adjusting a peg associated with a string until the user senses audio correlation with an external source. Generally, beginner students will have their instructor tune the string instrument by appropriately rotating a peg to provide proper tension load in an associated string. During a time interval, the peg may inadvertently become rotated or the string become stretched, resulting in an incorrect string pitch. The student or other inexperienced user not having the experience required for audio correlation would have to wait until the instructor could tune the instrument. Very often, not desiring to wait, the student will attempt to tune the instrument himself and overload the strings with tension, causing their rupture. Additionally, much time will be lost during the audio correlation process performed by an inexperienced user.

The closest prior art known to the inventor is the tuning system of which this invention is a continuation-in-part application. In the prior art system, specific indicia are secured to the peg and pegbox of a string instrument. Although such prior art systems are extremely useful in tuning string instruments, they require effort on the part of the user to positionally locate appropriate indicia which may be time consuming.

SUMMARY OF THE INVENTION

A string instrument tuning system for tuning a string instrument having at least one string passing in a longitudinal direction. The tuning system includes a first indication member formed on a surface of the string of the instrument with the indication member having at least one indicia zone. The system further includes a second indication member disposed on the instrument. The second indicator member has cooperative indicia for alignment with the first indicator member in the indicia zone for determining a tension load on the string of the instrument.

DESCRIPTION OF THE PREFERRED EMBODIMENTS

Figure 1:
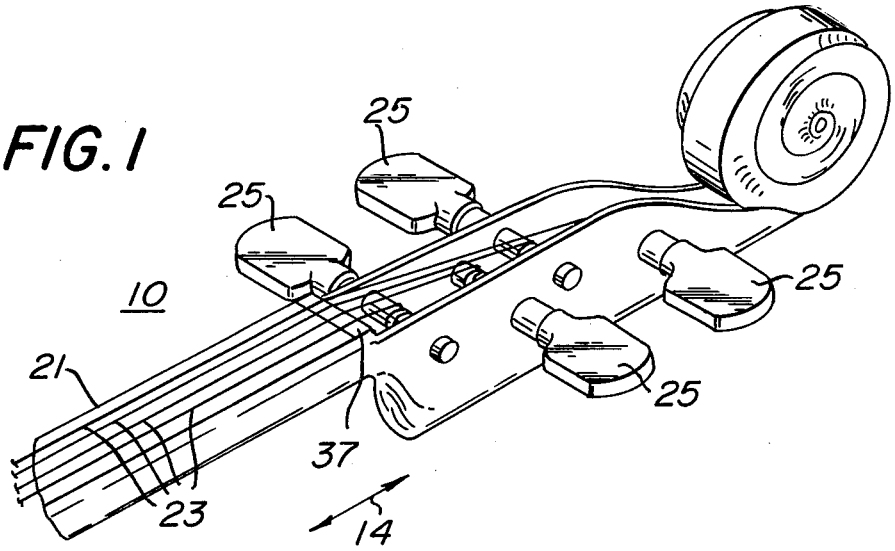
FIG. 1 is an isometric view of a portion of a string instrument showing the strings and their associated tuning pegs.
Figure 2:
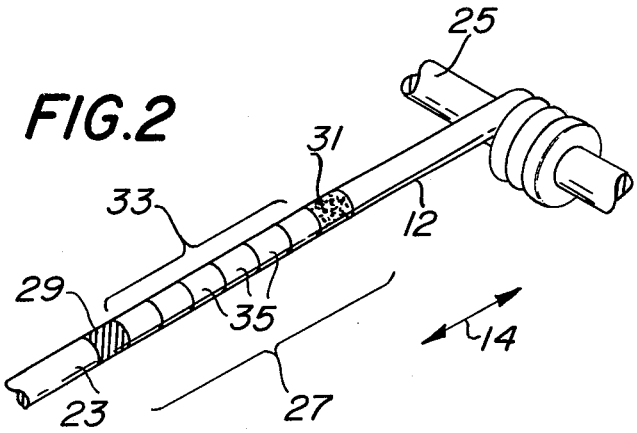
FIG. 2 is an enlarged perspective view of a portion of a string with first indicator string markings attached; and, FIG. 3 is a top view of the indicator markings on a string showing the various indication zones and bands.
Figure 3:
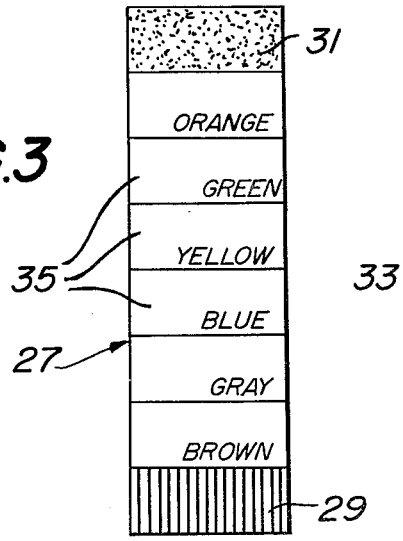

Referring now to FIGS. 1–3 where like numerals designate like or similar parts throughout, there is shown string instrument tuning system 10 for use in setting the proper tension load in a particular or set of strings 23 of stringed instrument 21. In overall concept, system 10 as is hereinafter described in following paragraphs allows a user to visually tune instrument 21 or at least bring instrument 21 into an appropriate fine tuning zone with a relatively high confidence level. This is of particular use when the operator is a minor whose coordination and musical ability to distinguish various pitches is not of optimum ability. Still further, system 10 may be utilized as a teaching aid for beginning musical students.

System 10, according to this invention, allows for the correct tuning of a string instrument 21 by providing a visual reference aid indicating the relative tension load in string 23 at all times during tuning. It provides a visual warning when string 23 has been tension loaded to such a degree where it may possibly rupture. Thus, this tuning system allows the user to manually rotate peg 25 associated with string 23 to a predetermined point while observing a visual reference indicating that the proper pitch of the string has been reached.

Referring now to FIGS. 2 and 3, string marker 27 is displayed upon the surface of string 23 of instrument 21. String marker 27 for illustrative purposes may be divided into three zones: high tension zone 29, low pitch zone 31, and pitch alignment zone 33. When aligned with reference indicator 37 described below, zones 29, 31 and 33 provide the user with visual information relating to the state of tension loading of string 23 at all times. High tension zone 29, farthest from peg 25 associated with string 23, defines a zone or band within which the tension load of string 23 is too high, indicating that string 23 may rupture. Low pitch zone 31, closest to peg 25, defines a zone within which the tension load of string 23 is too low, and will therefore designate a region in which the resonant pitch of string 23 may possibly be too low. Pitch alignment zone 33 is further divided into a plurality of pitch bands 35, which indicate relative tension and resulting resonant pitch of string 23.

The three indicia zones 29, 31, and 33 are defined by painted or otherwise coated markings placed upon an exterior surface of string 23 and must be adhered to the surface of string 23 in a manner that the function and touch quality of string 23 is substantially not impaired. It is intended that this invention not be limited to any particular form or method of such surface markings, with the exception that such markings are to be acceptable with regard to tonal qualities of string 23 when in use.

Thus, as has hereinbefore been described, string marker 27 defines a first means or member for indicating specific visual phenomena. First member 27 is formed on external surface 12 of string 23 of instrument 21 and has a plurality of indicia zones 29, 31, and 33 associated therewith. For purposes of clarity, string 23 is seen mounted on instrument 21 and extends in a longitudinal direction defined by directional arrow 14.

Tuning system 10 further includes reference indicator 37 for cooperation with string marker 27 and to provide a visual point of reference for string marker 27. Reference indicator 37 may be a mark or other indicia reference line or area placed upon instrument 21 or a particular element of instrument 21. For the purposes of illustration, reference indicator indicia 37 is shown in FIG. 1 to be on the nut of instrument 21.

In operation, peg 25 may be rotated to linearly displace and tension associated string 23. Peg 25 is rotationally displaced until a proper pitch range of string 23 is reached and determined by audio correlation or some like technique. Once an acceptable pitch range of string 23 has been attained, it is only necessary to observe the alignment of reference indicator 37 with one of the pitch bands 35 in pitch alignment zone 33 of string marker 27.

Cooperative alignment of indicators provides a reference or visual aid to determine the appropriate tension of string 23. Repeatability of cooperative alignment permits the user to reach an acceptable pitch zone in later usage of instrument 21 through visual determination. The plurality of pitch bands 35 is provided by color coding or some other means in order that they are distinguishable each from the other by visual determination. One such coding scheme is to make adjacent bands different colors. These various pitch bands 35 provide more specific alignment points within pitch alignment zone 33 for use at different time intervals to accomodate the natural stretching of string 23.

Thus, an inexperienced user may initially have reference indicator 37 aligned with a green colored pitch band 35 within pitch alignment zone 33. During use of instrument 21, throughout a series of time intervals, string 23 may be stretched or otherwise displaced. In this instance, retuning of instrument 21 may be necessitated so that the blue pitch band 25 of zone 33 will then be aligned with reference indicator 37 to provide acceptable audio correlation. Once a new visual reference is established, repeatability of pitch of string 23 may generally, if not exactly, be maintained by the user for a next time interval.

Thus, reference indicator 37 provides a second means or member disposed on instrument 21 having cooperative indicia for alignment with specific zones 29, 31 and 33 of first member 27 for determining a tension load on string 23 of instrument 21. The cooperative nature of members 27 and 37 permits visual tuning of instrument 21 to a relatively high degree of audio accuracy.

Included within string marker 27 is first zone 29 which is a warning zone that string 23 is loaded with excessive tension and that there may be a possibility of rupture if peg 25 were to be further rotatively displaced. Warning zone 29 is generally of a different color or texture or has other such visual distinction from pitch alignment zone 33 in order that it would become visually apparent to the user that maximum string tension had been reached. Clear visual warning would be given to avoid inadvertent string breakage, which would be of important significance especially to an inexperienced user.

String marker 27 further includes a third indicia zone 31 which when aligned with reference indicator 37 provides an indication that string 23 is below a set pitch. Thus, when reference indicator 37 has been aligned with one of pitch bands 35 of pitch alignment zone 33, rotative displacement of peg 25 in such a manner that string 23 is loosened, would give an immediate indication to the user that the string is below the desired pitch.

There has therefore been provided string instrument tuning system 10 that provides a clear visual indication of the tension loading of string 23. In its preferred embodiment, system 10 may use a predetermined existing member of instrument 21 to be visually aligned with markings painted or otherwise coated upon the surface of the strings 23. It is to be understood, many modifications and variations will occur to those of ordinary skill in the art based upon the teachings herein.

The essence of system 10 lies in the placement of indicia upon strings 23 in combination with particular elements to provide cooperative alignment, and a number of such element combinations suitable for alignment will satisfy the spirit of this invention. Many strings 23 are manufactured with wrappings extending over a portion of their surface. Markings could be placed directly on these wrappings by the use of paint or stain. Wrappings not covering the entire string could be extended further up the string so long as such wrappings did not substantially interfere with the acoustical properties of the instrument. Coatings could be placed on string 23 that are made from different materials, such as cloth, plastic, wire, rubber, synthetics and the like, so that indicia zones 29, 31, and 33 and pitch alignment band 35 could be easily distinguished. In essence, there are a number of combinations of materials useful for optically distinguishing the zones and bands.

There is likewise a wide range of choice for reference indicator 37. The optimum point of reference would naturally vary from instrument to instrument. On a violin, an excellent choice for reference indicator 37 would be peg 25. Either the front or back of peg 25 may be used or if the manufacturer desired, a reference line could be provided in the middle of the peg. Using peg 25 as reference indicator 37, the user would simply observe the string marker 27 as it wrapped around the peg while tightening. When the predetermined pitch band 35 appeared at the peg, a visual indication will have been provided that the instrument had been tuned. A string 23 which had been inadvertently or intentionally detuned would also present clear visual indication to the user by his observation of peg 25 as it aligned with string marker 27. Another convenient reference indicator 37 would be the nut of the violin, which is at the front edge of its peg box.

On instruments with frets, such as guitars, one of the frets itself could serve as reference indicator 37.

It is therefore to be understood that these and other modifications may be resorted to without departing from the spirit or scope of the invention. Equivalent elemental structures may be substituted for those specifically shown and described, certain features may be used independently of other features, and in some cases, portions may be reversed, all without departing from the spirit or the scope of the invention. Therefore, it is to be understood that the invention is limited only by the claims appended hereto.

What is claimed is:

1. A string instrument tuning system for tuning a string instrument having at least one string passing in a longitudinal direction, comprising:

(a) first means for indication formed on a surface of said string of said string instrument, said first indication means having at least one indicia zone, and, (b) second means for indication disposed upon said string instrument, said second indication means having cooperative indicia for alignment with said first indication means in said indicia zone for determining a tension load on said string of said instrument.

2. The string instrument tuning system of claim 1 wherein said first indication means includes at least one coating applied to an external surface of said string, said coating being visually discernable from a remainder of said string.

3. The string instrument tuning system of claim 2 wherein said coating is paint.

4. The string instrument tuning system of claim 2 wherein said coating is stain.

5. The string instrument tuning system of claim 1 wherein said first indicia means includes a first indicia zone having indicia bands for alignment with said cooperative indicia for determining the appropriate pitch of said strings.

6. The string instrument tuning system of claim 5 wherein said first indicia means further includes a second indicia zone defining a string tension warning zone for indicating an area within which said string may break when said cooperative indicia is aligned with said second indicia zone.

7. The string instrument tuning system of claim 5 wherein said first indicia means further includes a third indicia zone for indicating an area within which said string is below a predetermined pitch value when said cooperative indicia is aligned with said third indicia zone.

8. The string instrument tuning system as recited in claim 1 where said second indication means cooperative indicia passes substantially transverse to said longitudinal direction of said string.

9. The string instrument tuning system of claim 8 wherein said second indication means includes a nut member fixedly secured to said string instrument.

10. The string instrument tuning system of claim 8 wherein said second indication means includes a peg member of said instrument upon which said string is wound.

11. The string instrument tuning system of claim 1 wherein said second indication is a visually discernable reference indicia formed on said string instrument.

* * * * *